US005456611A

United States Patent [19]

Henry et al.

[11] Patent Number: 5,456,611

[45] Date of Patent: Oct. 10, 1995

[54] MINI-UHF SNAP-ON PLUG

[75] Inventors: Randall R. Henry, Harrisburg; William P. Moyer, Middletown, both of Pa.

[73] Assignee: The Whitaker Corporation, Wilmington, Del.

[21] Appl. No.: 148,738

[22] Filed: Oct. 28, 1993

[51] Int. Cl.[6] ..... H01R 13/627

[52] U.S. Cl. ..... 439/180; 439/578

[58] Field of Search ..... 439/152, 180, 439/462, 484, 578

[56] References Cited

U.S. PATENT DOCUMENTS

| | | | |
|---|---|---|---|
| 3,858,156 | 12/1974 | Zarro . | |
| 4,046,451 | 9/1977 | Juds et al. . | |
| 4,249,790 | 2/1981 | Ito et al. . | |
| 4,580,862 | 4/1986 | Johnson . | |
| 4,583,809 | 4/1986 | Werth et al. . | |
| 4,846,714 | 7/1989 | Welsby et al. | 439/180 X |
| 5,074,809 | 12/1991 | Rousseau | 439/578 X |
| 5,195,906 | 3/1993 | Szegda | 439/578 X |

*Primary Examiner*—Z. R. Bilinsky

*Attorney, Agent, or Firm*—William B. Noll

[57] ABSTRACT

This invention in its preferred embodiment, is directed to a miniature UHF type plug, more particularly to a female, snap-on coaxial cable connector for use with radio-frequency and other transmission lines, where such connector is electrically connectable to a male, receptacle connector, typically panel mounted and of a design as known in the art. The snap-on, coaxial connector comprises three primary members identified as a circular sleeve, a circular shell, and a circular collar. The circular sleeve includes a plurality of spaced-apart, axially oriented tynes along a first end thereof, and the circular shell consists of a cable crimping section, an intermediate section to be received within the sleeve, and a third section having a like plurality of spaced-apart, axially oriented tynes. The latter tynes are arranged to intermate with the first tynes, and the intermated tynes are adapted to receive the male, receptacle connector. The shell is further characterized by means to retain the axial position of the shell within said sleeve, and by means cooperating with the male, receptacle connector to prevent rotative movement therebetween, where preferably such means comprise a compliant, elastomeric spacer member. The circular retaining collar is provided to receive the sleeve, and cooperative means are further provided between the collar and the sleeve to limit the axial movement therebetween.

8 Claims, 3 Drawing Sheets

MINI-UHF SNAP-ON PLUG

BACKGROUND OF THE INVENTION

This invention is directed to a snap-on female coaxial connector for use on a stationary, or panel mounted, threaded male receptacle connector.

Such male receptacle connector, one embodiment of which is illustrated on U.S. Pat. No. 4,580,862, comprises a circular, wall mounted body having threads thereabout, i.e. standard UHF connector, for rotatably receiving a complementary threaded female coaxial connector. In this particular prior art embodiment for the male receptacle connector, a plurality of teeth are axially arranged about the mating end thereof. Typically, female connectors have been designed to threadably engage the male receptacle member, such as a T.V. or other communication outlet. However, there are situations where blind mating or limited access is available to effect the manual rotation of the complementary female connector. Accordingly, there has been some recent effort to effect a snap-on connection where mating is achieved by merely aligning and pushing one connector onto the other.

U.S. Pat. No. 3,858,156 is directed to a push-on connector, where the body of the male connector includes a plurality of resilient flaps or tabs which lock against the walls of the female connector.

U.S. Pat. No. 4,580,862 relates to a coaxial connector in which one connector member is floatably mounted for axial movement onto a fixed or panel mounted connector member, where the mating of the respective members is by sliding engagement of the male member within the female member.

Some of the shortcomings of prior art devices is the provision of a female connector or plug that can not only be pushed onto the male receptacle, be retained thereon against premature withdrawal, while being secured against rotative movement in the mated condition. The present invention achieves each such features in an expedient manner. The invention, including the unique features thereof, will become apparent in the description which follows, particularly when read in conjunction with the accompanying drawings.

SUMMARY OF THE INVENTION

This invention is directed to a miniature UHF type plug, more particularly to a female, snap-on coaxial cable connector for use with radio-frequency and other transmission lines, where such connector is electrically connectable to a male, receptacle connector. The snap-on, coaxial connector comprises three members identified as a circular sleeve, a circular shell, and a circular collar. The circular sleeve includes a plurality of spaced-apart, axially oriented tynes along a first end thereof, and the circular shell consists of a cable crimping section, an intermediate section to be received within the sleeve, and a third section having a like plurality of spaced-apart, axially oriented tynes. The latter tynes are arranged to intermate with the first tynes, and the intermated tynes are adapted to receive the male, receptacle connector. The shell is further characterized by means to retain the axial position of the shell within said sleeve, and by means cooperating with the male, receptacle connector to prevent rotative movement therebetween. The circular retaining collar is provided to receive the sleeve, and cooperative means are further provided between the collar and the sleeve to limit the axial movement therebetween.

DETAILED DESCRIPTION OF PREFERRED EMBODIMENT

The invention hereof relates to a snap-on, female coaxial connector for mating with a panel mounted, threaded male receptacle connector, for example. The components, and their interrelationship to form the connector 10 of this invention are illustrated in the several Figures.

Figure 1:
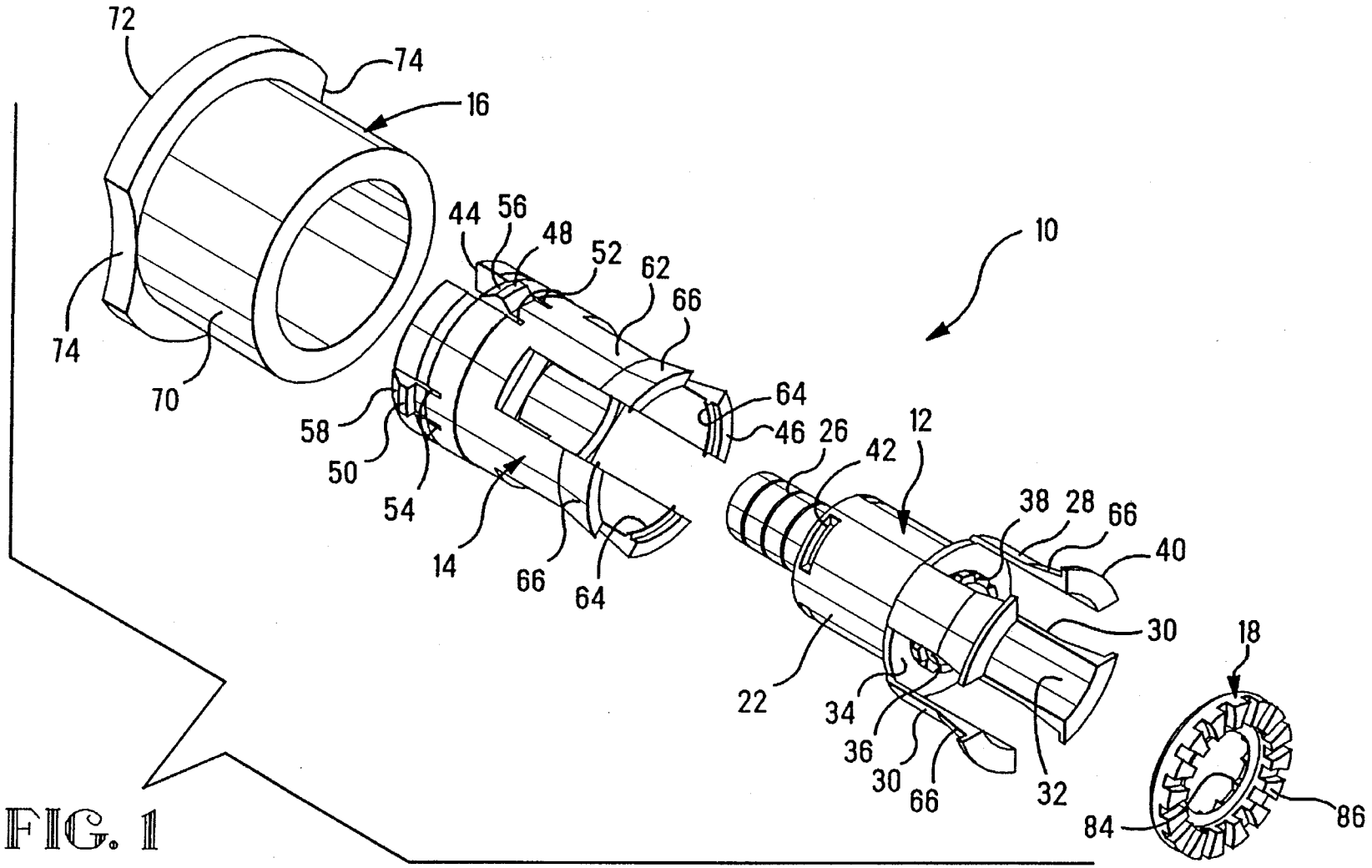
FIG. 1 is an exploded perspective view of the snap-on, female coaxial connector according to this invention.

FIG. 1 shows such components in an exploded relationship. The components thereof comprise a shell 12, preferably fabricated of a zinc die casting, a dielectric sleeve 14, a plastic retaining collar 16, and an elastomeric spacer 18. The shell 12 generally, circular in configuration, and having a central bore 20 therethrough, comprises an intermediate body portion 22, having an essentially uniform diameter 24, a reduced cable crimping portion 26 for crimping about and engaging a coaxial cable, as known in the art, and a rear end 28. The rear end 28 is characterized by a plurality of spaced-apart, axially oriented tynes 30, preferably four in number and spaced evenly thereabout, to define a circular opening 32 of a diameter to engage a circular threaded male receptacle member, as known in the art. The tynes 30 extend from an annual shoulder 34, where the central opening 36 is defined by a continuous toothed rim 38, the purpose whereof will become apparent hereinafter in conjunction with the elastomeric spacer 18. Finally, each tyne 30 is provided with a flange 40 to limit the relative axial movement of sleeve 14 when inserted therein.

The intermediate body portion 22, at the forward end thereof, includes plural, circumferentially disposed grooves 42, which cooperate with a corresponding number of inwardly directed shoulder or projections on the sleeve 14 to retain the relative position of the shell 12 and sleeve 14 in assembled condition.

The sleeve 14, which receives the shell 12, is circular in configuration and is characterized by a forward end 44 and a shell receiving end 46.

The forward end 44 of the sleeve 14 includes two pairs of oppositely disposed, axially oriented beams 48, 50, where such beams are free to flex toward and away from the axis of the sleeve 14 by virtue of the pairs of axial slot 52, 54. Note also that the beams 48 are displaced rearwardly of the beams 50. The reasons therefor will be better understood during the discussion on the assembly of the connector 10. Further, the forward end of each beam 48, 50 is provided with a ramped portion 56, 58, to facilitate mating and locking of the connector 10 in a manner to be discussed later.

Internally, the forward end 44 of the sleeve 14 is provided with an inwardly directed, circumferentially disposed ribs 60, which are received in the complementary grooves 42 about the shell 12, as explained above. The shell receiving end of the sleeve includes a plurality of tynes 62, typically a like number to the tynes 30 of the shell, where the tynes 62 are dimensioned and circumferentially arranged to interfit with the tynes 30, when the shell and sleeve are assembled. Each said tyne 62 is further provided with an inwardly directed helical rib 64 which is designed to snap into the threads of a complementary male receptacle plug (not shown but well known in the art), and to be secured thereon. Finally, it will be noted that the ends of tynes 30, 62 are tapered 66, slightly outwardly, to provide a snug interference fit with the collar 16 and to help retain the assembly about the male, receptacle plug.

Figure 2:
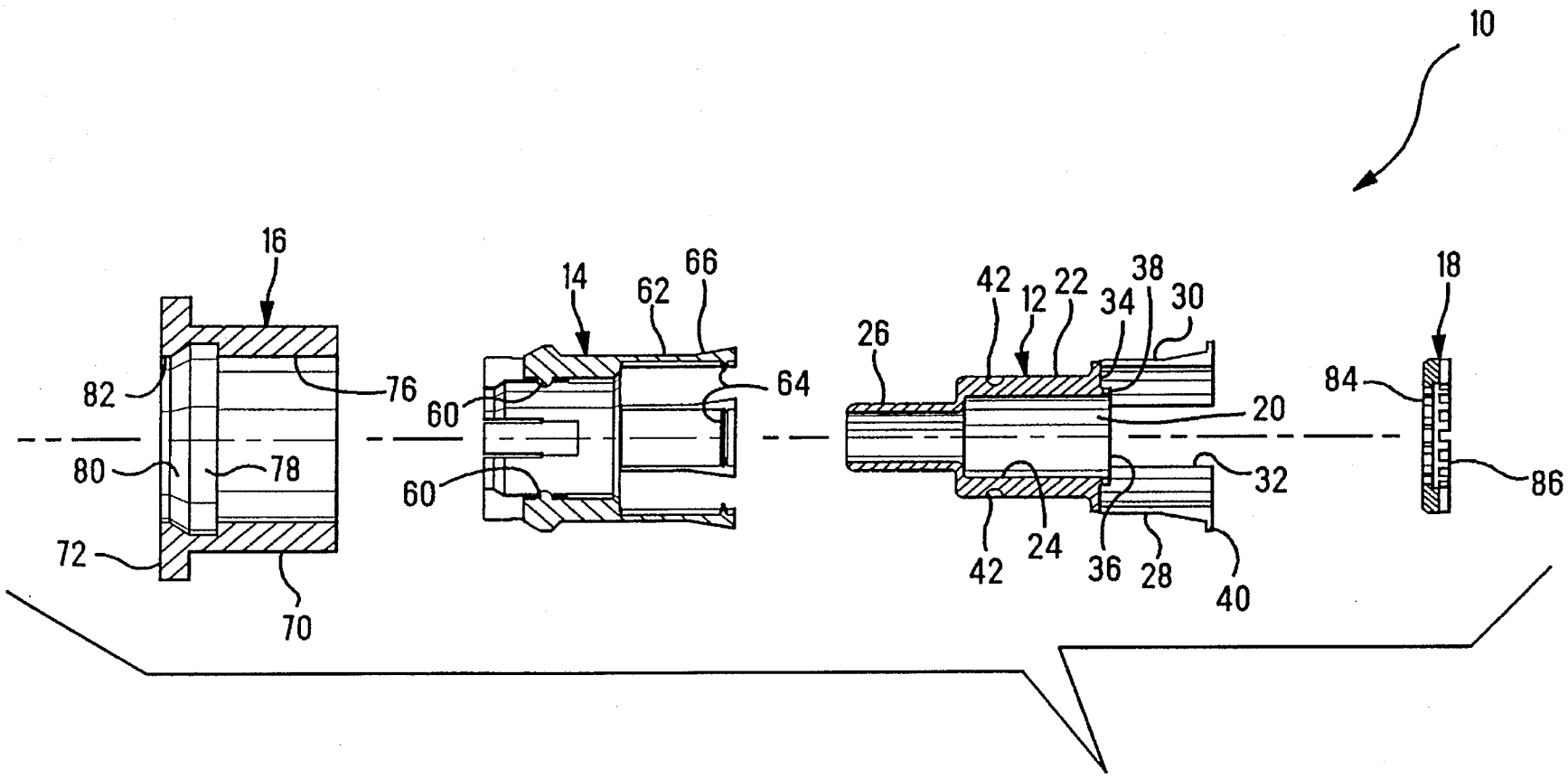
FIG. 2 is an exploded sectional view of the several components forming the connector of this invention.
Figure 4:
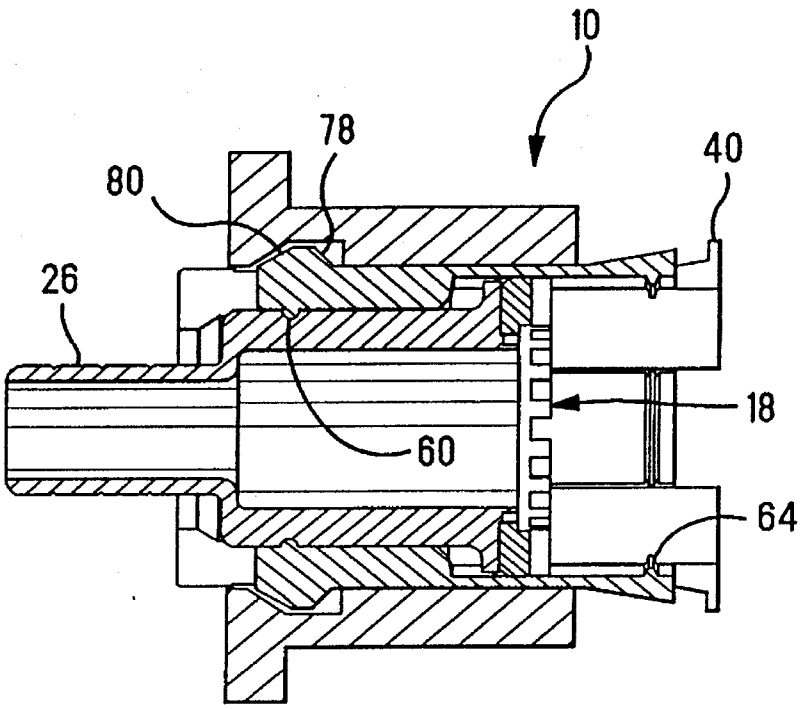
FIG. 4 is a sectional view of the assembled connector of FIG. 3.
Figure 3:
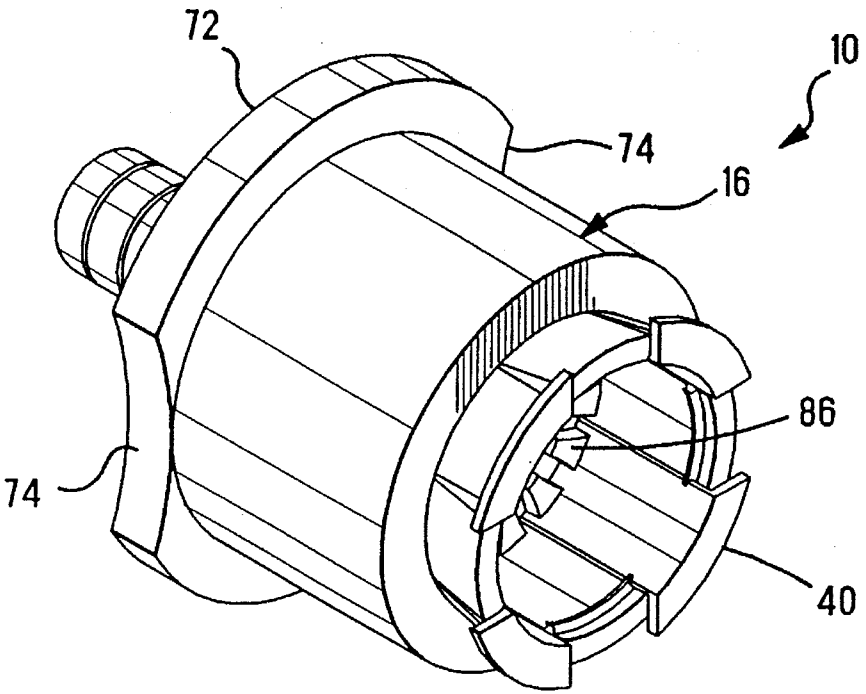
FIG. 3 is a perspective view of the assembled connector, less a cable terminated thereto, of the components illustrated in FIG. 1.

The collar 16, typically formed of plastic, includes a circular body portion 70 with a flange 72 about one end thereof. For convenience, the flange 72 may be provided with a pair of indents 74 to allow for gripping thereof for manually applying the assembly to a male receptacle plug. Internally, as best seen in FIG. 2, the collar has a uniform central bore 76 which terminates in an annular groove 78, where the forward end thereof is tapered 80 and converges towards the opening 82.

A further and final component is an elastomeric spacer 18. The spacer, on the respective major surfaces thereof, is characterized by a series of gear-like teeth 84, 86. The lower teeth 84 are arranged to mesh with the toothed rim 38, so as to fix same against rotative movement, while the upper teeth 86 engage or mesh with the teeth on the male, receptacle plug (see FIG. 1, item 16 of U.S. Pat. No. 4,580,862), incorporated herein by reference. As will be observed hereinafter, when the spacer 18 is placed on the annular shoulder 34, where the respective teeth mesh, and the assembly placed on the male, receptacle plug, the spacer 18 assures consistent seating of the sleeve ribs 64 into the threads of the male, receptacle plug, while preventing rotation of the connector 10 after mating.

To assemble the connector of this invention the shell 12 is inserted into the sleeve 14, with the respective tynes 30, 62 are radially aligned, where the ribs 60 snap into the corresponding grooves 42. Thereafter, such assembly is inserted into the collar 16 up to a first position where the forward most beams 50 seat into the annular groove 78. Finally, the spacer 18 is press fit between the tynes 30 onto shoulder 34 in contact with the teeth 38. In this preliminary assembled condition, a coaxial cable may be terminated thereto as known in the art, typically performed by the customer/user. The connector 10 may now be mated with a male, plug receptacle connector. As the connector is placed on the bulk head of the plug receptacle, i.e. by axially pushing the connector 10 onto the bulk head, the helical ribs 64 begin to engage the threads thereof, and the elastomeric spacer 18 is essentially compressed therebetween. In this position, the collar 16 axially shifts to a second position where the rearward beams 48 move into the annular groove 78. Concurrently, the collar wall 76 is cammed against the tapered portion 66 of the respective tynes 30, 62, pushing them inwardly into a tighter gripping arrangement with the bulk head of the plug receptacle. Due to the compliancy of the spacer 18, and the interlocking teeth 84, 86 thereabout, consistent seating of the helical ribs 64 in the threads is achieved, and rotation of the connector 10 is prevented.

We claim:

1. A female, snap-on coaxial cable connector for use with radio-frequency and other transmission lines and electrically connectable with a male, receptacle connector, said female, snap-on, coaxial connector comprising a) a circular sleeve having a plurality of spaced-apart, axially oriented tynes along a first end thereof, b) a circular shell consisting of a cable crimping section, an intermediate section to be received within said sleeve, and a third section having a like plurality of spaced-apart, axially oriented tynes, where the latter tynes are arranged to intermate with said first tynes, and said intermated tynes are adapted to receive said male, receptacle connector, i) said shell including means to retain the axial position of said shell within said sleeve, ii) said shell further including means cooperating with said male, receptacle connector to prevent rotative movement therebetween, and c) a circular retaining collar within which said sleeve is received, where cooperative means are provided between said collar and said sleeve to limit the axial movement therebetween.

2. The female, snap-on, coaxial cable connector according to claim 1, where said male, receptacle connector is externally threaded, and that said first tynes include helically oriented ribs for engagement with said threads.

3. The female, snap-on, coaxial cable connector according to claim 1, wherein the opposite end of said sleeve includes a plurality of axially oriented beams, where a number of said beams include an inwardly directed, annularly arranged rib for engagement with a corresponding groove in said intermediate section of said circular shell.

4. The female, snap-on, coaxial cable connector according to claim 3, wherein at least a pair of said beams include outwardly directed, radial ramps for engagement with a circumferential slot within said circular retaining collar.

5. The female, snap-on, coaxial cable connector according to claim 4, wherein there are at least a second pair of said beams having outwardly, directed ramps and axially offset from said remaining beams.

6. The female, snap-on, coaxial cable connector according to claim 2, where said male, receptacle connector includes a continuous row of axially oriented teeth along a mating face thereof, and said shell is provided with an elastomeric spacer member to coact with said teeth to prevent relative rotative movement between said male, receptacle connector, and said female connector.

7. The female, snap-on, coaxial cable connector according to claim 5, wherein during assembly of said connector said radial ramps engage said circumferential slot to define a preliminary assembled position, and after further relative axial movement of said sleeve to said collar said outwardly directed ramps engage said circumferential slot.

8. The female, snap-on, coaxial cable connector according to claim 7, wherein said tynes include tapered surfaces which are cammed against the wall of said collar to radially restrict the opening between said tynes.

* * * * *